US011375831B2

(12) United States Patent
Shendelman

(10) Patent No.: US 11,375,831 B2
(45) **Date of Patent: *Jul. 5, 2022**

(54) PROPELLER FOOD PLATE ASSEMBLY FOR USE IN DINING AND RECREATIONAL ACTIVITIES

(71) Applicant: Leonid Shendelman, Brooklyn, NY (US)

(72) Inventor: Leonid Shendelman, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/240,686

(22) Filed: Apr. 26, 2021

(65) Prior Publication Data

US 2021/0244212 A1 Aug. 12, 2021

Related U.S. Application Data

(63) Continuation of application No. 16/009,334, filed on Jun. 15, 2018, now Pat. No. 11,019,947.

(51) Int. Cl.
*A63H 33/18* (2006.01)
*A47G 19/02* (2006.01)

(52) U.S. Cl.
CPC ..... *A47G 19/025* (2013.01); *A63H 33/18* (2013.01); *A47G 2200/08* (2013.01); *A47G 2400/00* (2013.01)

(58) Field of Classification Search
CPC ..... A63H 33/18; A63H 27/14; A47G 19/025; A47G 2400/00; A47G 2200/08; F41J 9/16
See application file for complete search history.

(56) References Cited

U.S. PATENT DOCUMENTS

| | | | |
|---|---|---|---|
| 688,753 | A | 12/1901 | Storrs |
| 811,784 | A | 2/1906 | Mattteson |
| 1,221,217 | A | 4/1917 | Quinliven et al. |
| 1,734,045 | A | 11/1929 | Parran |
| 2,000,301 | A | 5/1935 | Snodgrass et al. |
| 2,013,901 | A | 9/1935 | Shankland |
| 2,232,031 | A | 2/1941 | Kavanagh |
| 2,347,823 | A | 5/1944 | Goodman et al. |
| 2,591,855 | A | 4/1952 | Nicholson |

(Continued)

FOREIGN PATENT DOCUMENTS

GB 657859 * 5/1949

OTHER PUBLICATIONS

Application and File history for U.S. Appl. No. 16/009,334, filed Jun. 15, 2018, Inventor: Shendelman.

*Primary Examiner* — Anthony D Stashick
*Assistant Examiner* — Blaine G Neway
(74) *Attorney, Agent, or Firm* — Patterson Thuente Pedersen, P.A.

(57) ABSTRACT

A propeller food plate assembly has a plate component and a propeller component that includes a plurality of propellers that subdivide the plate into a plurality of compartments for holding food during a dining activity. During a different recreational activity, the components rotate when the assembly is thrown and spun in the air. During flight, the components initially engage each other in a torque-transmitting relationship, and subsequently move apart. The propellers have contoured, aerodynamic surfaces configured to enhance an aerodynamic flight characteristic of the assembly, One or more light sources may be mounted on the assembly to emit light.

16 Claims, 16 Drawing Sheets

(56) References Cited

U.S. PATENT DOCUMENTS

| | | | | |
|---|---|---|---|---|
| 3,094,264 | A | 6/1963 | Petrone | |
| 3,193,139 | A | 7/1965 | Iannone et al. | |
| 3,499,538 | A | 3/1970 | Sherard et al. | |
| 4,077,155 | A | 3/1978 | Brungmyer | |
| 4,846,749 | A | 7/1989 | Petko | |
| 4,907,707 | A | 3/1990 | Crum | |
| 5,032,098 | A * | 7/1991 | Balogh | A63H 33/18 446/47 |
| 5,042,666 | A | 8/1991 | Dolenc | |
| 5,178,298 | A | 1/1993 | Allina | |
| 5,474,482 | A * | 12/1995 | Davidson | A63H 27/12 446/219 |
| 5,493,976 | A | 2/1996 | Hammond | |
| 6,543,639 | B1 | 4/2003 | Kovens | |
| 8,282,437 | B2 | 10/2012 | Norman et al. | |
| 9,119,506 | B2 | 9/2015 | Shendelman | |
| 9,345,352 | B2 | 5/2016 | Shendelman | |
| 9,636,597 | B2 * | 5/2017 | Rehkemper | A63H 3/52 |
| 9,901,202 | B2 | 2/2018 | Shendelman | |
| 10,004,996 | B2 * | 6/2018 | Frost | H04N 7/181 |
| 10,182,675 | B2 | 1/2019 | Shendelman | |
| 10,849,446 | B2 | 12/2020 | Shendelman | |
| 2014/0242230 | A1 | 8/2014 | Iwegbu | |
| 2014/0314902 | A1 | 10/2014 | Maynard | |
| 2015/0265080 | A1 | 9/2015 | Bagi et al. | |
| 2016/0120342 | A1 | 5/2016 | Petersburg | |
| 2018/0184823 | A1 | 7/2018 | Miller et al. | |
| 2018/0296012 | A1 | 10/2018 | Woods | |
| 2019/0380518 | A1 | 12/2019 | Shendelman | |

* cited by examiner

PROPELLER FOOD PLATE ASSEMBLY FOR USE IN DINING AND RECREATIONAL ACTIVITIES

RELATED APPLICATION

This application is a continuation of application Ser. No. 16/009,334 filed Jun. 15, 2018, which is hereby fully incorporated herein by reference.

FIELD OF THE DISCLOSURE

The present disclosure generally relates to a propeller food plate assembly having a plate component that includes a plate for holding and consuming food and/or liquid substances during a dining activity, and a propeller component that includes a plurality of propellers connected to a collar, the propeller component being initially in a torque-transmitting relationship with the plate component and being subsequently movable relative to the plate component after the propeller food plate assembly is thrown and spun in the air, for example, during a "throw-and-catch" recreational sports activity among a plurality of people,

BACKGROUND

Guests fill their plates with food served buffet-style at social functions, and typically either hold their plates in cantilever fashion by gripping peripheral edges of the plates, or balance their plates on their laps, If drinks are also served, the guests typically either hold their drink containers in their other hands, or balance the drink containers on their plates, Due to the difficulty in performing such balancing, and due to the difficulty of supporting the plates and the drink containers without food or liquid spillage, guests often seek out a table or like supporting surface or even the floor, to support their plates and drink containers. Yet, this action tends to anchor guests to a specific location and prevents the guests from roaming and socializing. In a similar vein, customers of take-out or drive-through restaurants, snack bars, concession stands, and like premises, who are served food on plates and drinks in drink containers, often find it difficult to support them all without spillage, especially when leaving and carrying the food and drink away from the premises for subsequent consumption at another location, for example, at their homes, in their vehicles, or in their seats at movies, concerts, sporting events, other recreational activities, etc.

After consumption of the food and drink, the known plates are typically discarded. Yet, it would be desirable not to simply throw the plates away in the trash, but to encourage and motivate some sort of physical, preferably outdoor, activity, not only to enhance the happy, fun atmosphere of the social function, but also to fight obesity by having the individuals exert themselves physically, and to physically interact in a fun, recreational, athletic activity, including interaction with pets.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the instant disclosure, and explain various principles and advantages of those embodiments.

Figure 1:
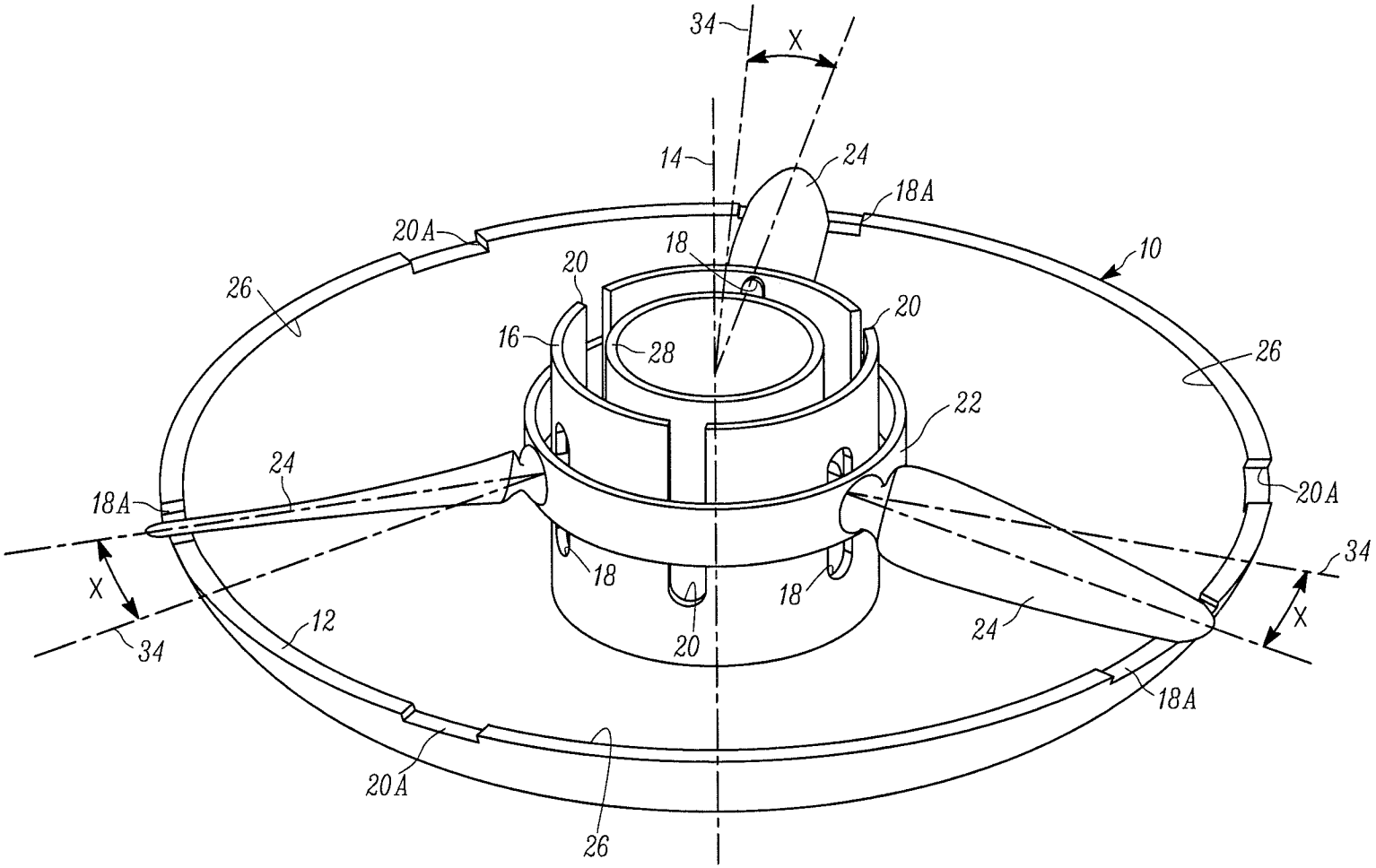
FIG. 1 is a perspective view of one embodiment of a propeller food plate assembly in accordance with this disclosure.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present disclosure.

The components of the propeller food plate assembly have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein,

DETAILED DESCRIPTION

In accordance with this disclosure, a propeller food plate assembly comprises a plate component that includes a plate having a periphery surrounding an axis, preferably a vertical axis, and a raised central portion centered on, and extending upwardly from the plate along, the vertical axis. In some embodiments, the raised central portion has a plurality of slots, and these embodiments are sometimes referred to hereinafter as "slotted" embodiments. In other embodiments, the raised central portion has no slots, and these embodiments are sometimes referred to hereinafter as "unslotted" embodiments. The slots in the slotted embodiments may extend generally parallel to the vertical axis, or they may be inclined relative to the vertical axis.

The propeller food plate assembly also includes a propeller component that includes a collar also centered on the vertical axis and located exteriorly of the central portion with a clearance, and a plurality of ribs or aerodynamically shaped propellers angularly arranged about the vertical axis. In the slotted embodiments, the propellers extend from the slots through the collar towards and past the periphery of the plate to subdivide the plate into a plurality of compartments for holding food during a dining activity. When the propeller component and the plate component are assembled together, the propeller component is mounted on the plate component with the clearance, In a preferred embodiment, the propellers are advantageously locked in position on the plate to resist movement during the dining activity and are unlocked during a different recreational activity. In the slotted embodiments, the propellers have inner ends mounted in the slots with a clearance. The inner ends are movable along the slots after the propellers are unlocked during the recreational activity.

At a beginning or initial stage of the recreational activity or flight, the propeller food plate assembly is initially thrown and spun, i.e., rotated, in the air by a user. As described below, the propeller component and the plate component initially engage each other in a torque-transmitting relationship during their joint rotation about the vertical axis during such flight and, together with the propellers that have contoured, aerodynamic surfaces, cause the assembly to further spin and rotate about the vertical axis with an enhanced aerodynamic flight characteristic, which is a flight pattern determined and controlled, at least in part, by the aerodynamic surfaces of the specific propellers that are used. At a subsequent stage of the flight, the propeller component, i.e., the propellers and the collar together, moves relative to the central portion away from the plate component. Thus, the propeller component is movable relative to, and may be detachable from, the plate component.

In the slotted embodiments, each of the central portion and the collar preferably has a cylindrical shape. In the unslotted embodiments, each of the central portion and the collar preferably has a polygonal shape. The collar may be constituted of a single part, or of a plurality of collar segments. The collar segments are not only easy to assemble with each other, but are also easy to assemble with the central portion, The propellers may be interchangeably and detachably mounted on the collar to enhance the aerodynamic flight characteristics or flight pattern, The propellers and the collar may also be molded of one-piece construction.

In the slotted embodiments, the slots may be linear and equiangularly arranged about the vertical axis on the central portion. The slots may be upwardly closed at an upper region of the central portion to confine the inner ends of the propellers in the upwardly closed slots during the recreational activity, or the slots may be upwardly open at an upper region of the central portion to enable the inner ends of the propellers to escape the upwardly open slots during the recreational activity, Both the upwardly open slots and the upwardly closed slots may be provided in the same embodiment of the propeller food plate assembly. The upwardly open slots and the upwardly closed slots may, in some embodiments, extend radially all the through the central portion, or, in other embodiments, the upwardly open slots and the upwardly closed slots may extend only partially through the central portion and, in effect, form radially outwardly open cavities on an outer surface of the central portion.

The inner ends of the propellers may be advantageously configured as linear pins that extend along pin axes extending radially of the axis<The propellers and the collar are preferably constituted of flexible, resilient materials. During assembly, when the upwardly closed slots are used, the propeller component is initially placed above the plate component, and the upper end region of the central portion may advantageously be formed with an angled, annular, tapered guide along which the linear pins slide for easy assembly. The propeller component may be slightly tilted relative thereto in order to insert at least one of the linear pins in a corresponding upwardly closed slot. Thereupon, the resilient collar is forced with a pressure force downwardly over the central portion towards a bottom of the plate, and the remaining linear pins press against the central portion to cause the resilient collar to flex radially outwardly as the resilient collar approaches the bottom of the plate until the remaining linear pins enter, and are mounted with clearance in, the remaining upwardly closed slots.

For easy assembly when the upwardly open slots are used, the propeller component is also initially placed above the plate component. When the linear pins are angularly aligned with the upwardly open slots, the propeller component is moved downwardly toward the plate component, and the linear pins freely enter the upwardly open slots, thereby completing the assembly.

The resilient propellers may also be flexed, bent and angularly offset from the pin axes, thereby tensioning the propellers prior to locking the propellers in position on the plate. The periphery of the plate preferably bas a plurality of slits, and the tensioned propellers have outer ends that are pushed with pressure into, received in, and tightly held in, the slits in order to lock the tensioned propellers in position on the plate during the dining activity, In addition, the plate may optionally have a holder, preferably cylindrical in shape, for holding a cup for containing a liquid substance, such as a beverage, and the holder is preferably centered on the axis and is located within the central portion with a clearance, which is preferably annular. The plate may also have a finger hole in its center and located within the holder, This enables a user to insert a finger, e.g., a thumb, through the finger hole and to bold and support the propeller food plate assembly during the dining activity adjacent a center of gravity of the propeller food plate assembly, The inserted finger is completely isolated from the food, thereby enhancing hygienic and sanitary dining. The holder has a solid surface that prevents the inserted finger from entering in the annular clearance between the holder and the center portion and from potentially coming into inadvertent contact with any food that may have entered the annular clearance from the food compartments. The annular clearance can also serve to collect any liquid that may have spilled from the cup in the bolder, and the solid surface of the holder again serves to prevent and isolate the inserted finger from potentially coming into inadvertent contact with any such spilled liquid that may have collected in the annular clearance. The annular clearance can also serve as a convenient ashtray. Only one of the user's hands is needed to support the propeller food plate assembly during the dining activity.

Only a single propeller component is used during the dining activity. In another modification used in a recreational activity, a plurality of the aforementioned propeller components, each comprising a respective plurality of the propellers and a respective collar, may be stacked or combined in levels or tiers, one directly above, and aligned with, one another, on the plate along the vertical axis. All the directly stacked, combined propeller components may be considered as acting as a single propeller component, and the propellers of each additional propeller component increase the total aerodynamic surface area, as compared to that of a single propeller component, to enhance the aerodynamic flight characteristic of the assembly. In a variation, the plurality of the aforementioned stacked propeller components may be angularly offset from each other about the vertical axis. Each additional propeller component increases the number of propellers for the propeller food plate assembly to enhance its aerodynamic flight characteristic and its flying performance. During the subsequent stage of the flight, this enables one, or more, or all, of the propeller components to move along the slots in the slotted embodiments. When the slots are upwardly open, then one, or more, or all, of the propeller components may escape and fly away or glide from the plate component, one by one, due to inertia during the recreational activity.

For the slotted embodiments, the inner ends of the propellers are positioned in the slots so that the plate component and the propeller component physically engage each other and initially jointly rotate in a torque-transmitting relationship at least until these components subsequently separate from each other during the recreational activity. For the unslotted embodiments, wherein there are no slots for the inner ends of the propellers to be inserted, the physical engagement between a polygonal central portion of the plate component and a surrounding polygonal collar of the propeller component enables their initial joint rotation in a torque-transmitting relationship at least until these components subsequently separate from each other during the recreational activity.

One or more light sources, such as chemiluminescent glow sticks, may be mounted on, and extend along, an upper surface of at least one of the collars of the propeller components, and/or on, and along, the periphery of the plate component, and/or at the underside of the plate component, to create an attractive and ornamental light display not only during the recreational activity, but also during the dining activity, especially at night. Alternately, a light-transmissive cover may be mounted on a bottom surface of the plate component, and a battery-operated light source and/or a camera may be mounted between the cover and the plate component. The camera may capture and record images, and/or transmit captured images via wireless link, e.g., Wi-Fi, Bluetooth, etc., to a receiver or display, for example, on one's smartphone, tablet, computer, etc. The battery may be mounted on the cover, or may be supplied by an overhead support that is mounted, preferably by snap action, to a central neck that extends downwardly from the aforementioned finger hole at the center of the plate component. Advantageously, the cover presses the battery and/or camera to help secure them in place. The light sources may emit light of different colors that are characteristic of different holidays, such as red, white and blue in celebration of the Fourth of July holiday, or of different colors on flags of various countries in celebration of their national holidays, or of different colors of various sports teams, etc.

Figure 2:
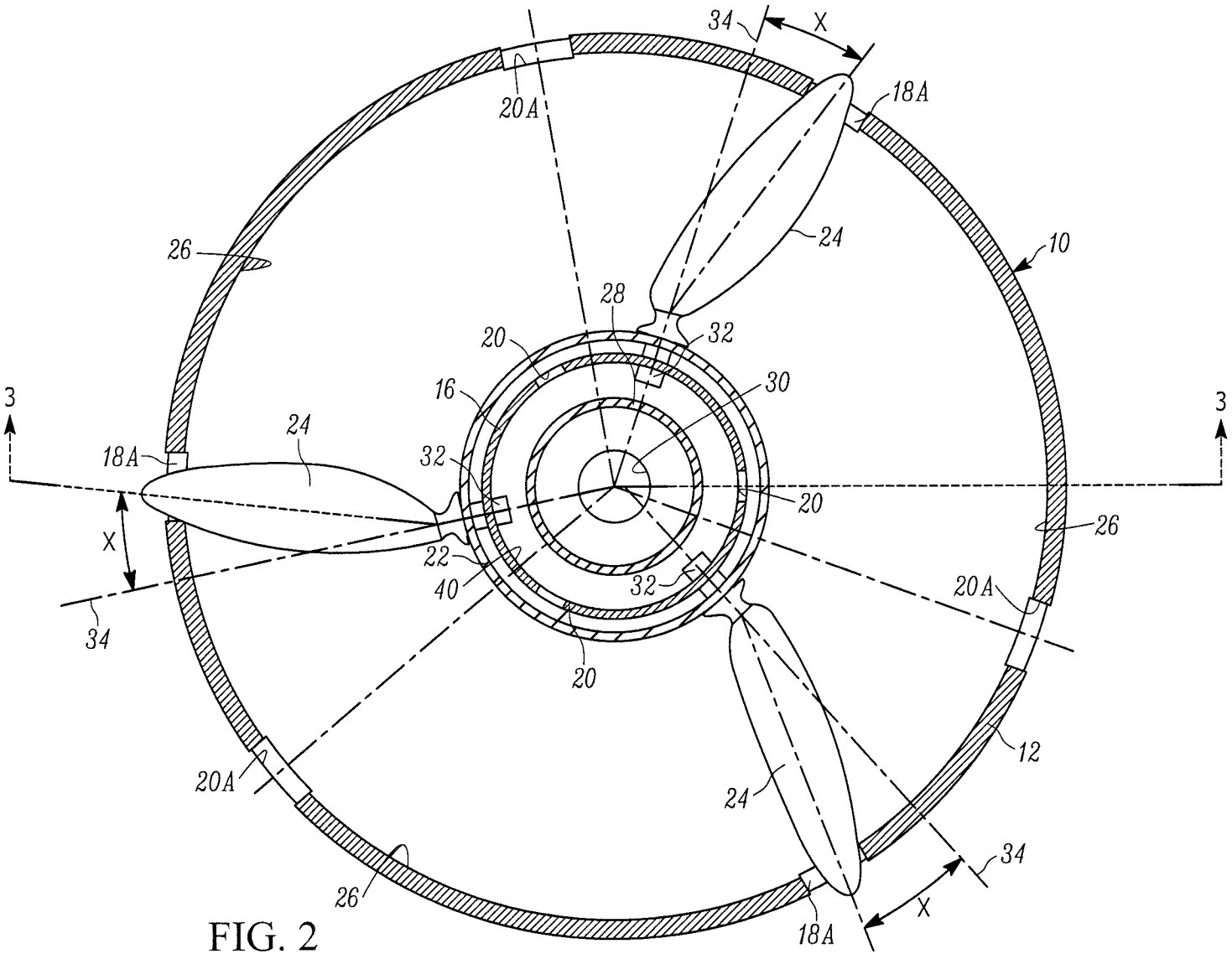
FIG. 2 is a top plan view of the embodiment of the propeller food plate assembly of FIG. 1 in a locked state.
Figure 3:
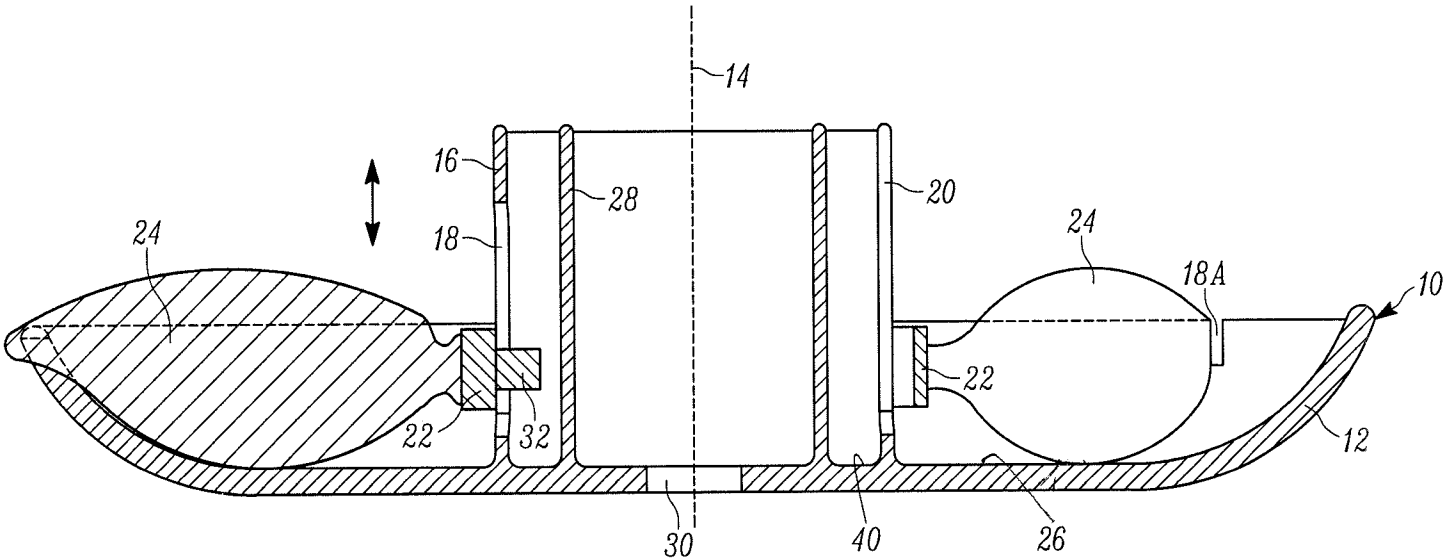
FIG. 3 is a sectional view taken on line 3-3 of FIG. 2.

Turning now to the slotted embodiment shown in FIGS. 1-3 of the drawings, a portable, multiple use, propeller food plate assembly comprises two components. The first or plate component includes a plate 10 having a generally circular periphery 12 surrounding an upright or vertical axis 14, and a raised central portion 16 centered on, and extending upwardly from the plate 10 along, the vertical axis 14. The central portion 16 has a plurality of closed slots 18 and/or a plurality of open slots 20. As shown, each slot 18 and 20 extends generally parallel to the vertical axis 14. It will be understood that each slot 18 and 20 may also be inclined relative to the vertical axis 14. The raised central portion 16 is preferably integral with the plate 10. Each slot 20 is upwardly open and exposed at an upper region of the central portion 16, and each slot 18 is upwardly closed because it is not open or exposed at the upper region of the central portion 16.

In this slotted embodiment, each slot 18 and 20 also extends radially all the through the central portion 16 (see FIG. 3). The central portion 16 may have any shape, preferably cylindrical as shown in FIG. 2, and the slots 18 and 20 are preferably linear and equiangularly arranged about the vertical axis 14 on the central portion 16. The central portion 16 may be provided with a set of only the upwardly closed slots 18, or a set of only the upwardly open slots 20, or may be provided with both types and sets of slots 18 and 20, as shown. The plate 10 may be made of a disposable, biodegradable material, such as paper or cardboard, or of a more permanent material, such as metal, plastic, etc., for re-use.

The second or propeller component of the propeller food plate assembly includes a collar 22 centered on the vertical axis 14 and located exteriorly of the central portion 16. The collar 22 may have any shape, preferably cylindrical or ring-shaped as shown in FIG. 2. In FIG. 2, the collar 22 circumferentially closely surrounds the central portion 16 and bounds an annular space 40 or clearance therewith. The propeller component also has a plurality of ribs or aerodynamically shaped propellers 24 angularly arranged about the vertical axis 14 and extending from the slots 18 or 20 through the collar 22 towards and past the periphery 12 of the plate 10 to subdivide the plate 10 into a plurality of compartments 26 for holding food during a dining activity. The food may comprise any edible substance. The propellers 24 and the collar 22 are preferably constituted of flexible, resilient materials.

Figure 1A:
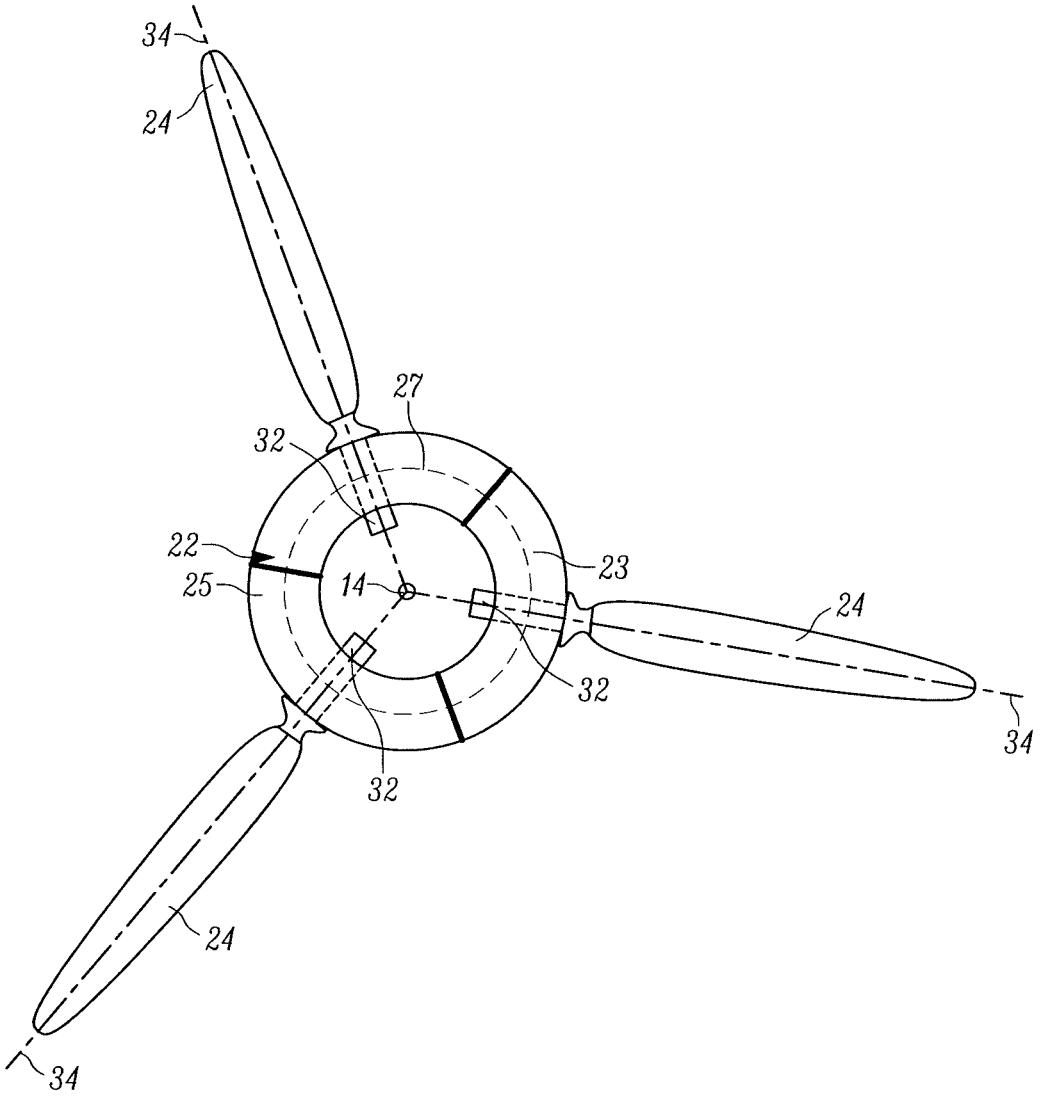
FIG. 1A is a top plan view of a propeller component of the embodiment of the propeller food plate assembly of FIG. 1.

Prior to assembly, the propeller component and the plate component are separate components. FIG. 1A depicts the propeller component by itself. The collar 22 may be constituted of one part as shown in FIG. 1, or may be constituted of a plurality of collar segments 23, 25, 27 that are interconnected as one piece, as shown in FIG. 1A. The collar segments 23, 25, 27 are not only easy to assemble with each other, but are also easy to assemble with the central portion 16, as described below. The collar 22 and the propellers 24 may also be molded of a one-piece construction. The propellers 24 have inner ends that may be configured as linear cylindrical pins 32. As shown in FIG. IA, the pins 32 extend through the collar 22 along pin axes 34 extending radially of the vertical axis 14.

During assembly, when the upwardly closed slots 18 are used, the propeller component is initially placed above the plate component, and may be slightly tilted relative thereto in order to insert at least one of the linear pins 32 in a in a corresponding upwardly closed slot 18. Thereupon, the resilient collar 22 is forced with a pressure force downwardly over the central portion 16 towards a bottom of the plate 10, and the remaining linear pins 32 press against the central portion 16 to cause the resilient collar 22 to flex radially outwardly as the resilient collar approaches the bottom of the plate 10 until the remaining linear pins 32 enter, and are mounted with clearance in, the remaining upwardly dosed slots 18. As described below in connection with FIG. 5, the upper end region of the central portion 16 may advantageously be formed with an angled, annular, tapered guide 36 along which the linear pins 32 initially slide for easy assembly.

In the case where the collar 22 is constituted of the plurality of collar segments 23, 25, 27, then each collar part, as shown in FIG. 1A, has its own propeller 24 with its own linear pin 32. Each such linear pin 32 may be inserted into a respective upwardly closed slot 18 until all the collar segments 23, 25, 27 are assembled, one by one, around the central portion 16, and are interconnected with each other as one piece. Thus, this simplifies the overall assembly of the collar 22 with the central portion 16, and the aforementioned pressure force is not exerted. In the event that the upwardly open slots 20 are used with the plurality of collar segments 23, 25, 27, then the collar segments should advantageously be connected together, for example, with snaps, to be of a one-piece construction, When the upwardly open slots 20 are used, the propeller component is also initially placed above the plate component. When the linear pins 32 are angularly aligned with the upwardly open slots 20, the propeller component is moved towards the plate component, and the linear pins 32 freely enter the upwardly open slots 20, thereby completing the assembly. FIG. 1 depicts the propeller food plate assembly, as finally assembled.

Although three propellers 24, three compartments 26, three upwardly dosed slots 18, and three upwardly open slots 20 have been illustrated in the embodiment of FIGS. 1-3, a different number of the propellers 24, a different number of the compartments 2.6, a different number of the upwardly dosed slots 18, and a different number of the upwardly open slots 20 are also within the scope of this disclosure. As mentioned above, the collar 22 and the central portion 16 may each have any shape, preferably cylindrical, and any single embodiment may have only the upwardly open slots 20, or only upwardly closed slots 18, or any desired combination of the upwardly closed slots 18 and the upwardly open slots 20.

The plate 10 may also optionally have a holder 28, preferably generally cylindrical in shape, for holding a cup for containing a liquid substance. The liquid substance can, for example, be water, or any beverage, either hot or cold, either alcoholic or non-alcoholic. Examples of beverages include, but are not limited to, soda, cocktails, champagne, juice, milk, milkshakes, coffee, tea, hot chocolate, etc. The liquid substance can also be any semi-liquid or semi-solid substance, such as soup, ice cream, yogurt, custard, sherbet, ices, etc. The holder 28 is centered on the axis 14 and is located within the central portion 16 and bounds the aforementioned clearance 40 therewith whose function is described below. The clearance 40 preferably has an annular shape.

The plate 10 advantageously also has a finger hole 30 in its center. The finger hole 30 extends entirely through the plate 10 to enable a user to insert a finger, preferably the thumb, through the finger hole 30 and to hold and support the plate 10 during the dining activity adjacent a center of gravity of the propeller food plate assembly. The inserted finger is completely isolated from the food substances in the compartments 26, thereby enhancing hygienic and sanitary eating.

The holder 28 has a solid surface that prevents the inserted finger from entering in the clearance 40 between the holder 28 and the central portion 16 and from potentially coming into inadvertent contact with any food that may have entered the clearance 40 from the food compartments 26. The clearance 40 can also serve to collect any liquid that may have spilled from the cup in the holder 28, and the solid surface of the holder 28 again serves to prevent and isolate the inserted finger from potentially coming into inadvertent contact with any such spilled liquid that may have collected in the clearance 40. The clearance 40 can also serve as a convenient ashtray. Only one of the user's hands is needed to support the plate 10 and the liquid-filled cup during the dining activity.

As described so far, during an eating and/or drinking or analogous dining activity, the plate 10 can hold food substances in the compartments 26 and can optionally hold a liquid substance in a cup mounted in the holder 28. As described below, the propellers 24 are advantageously held tightly against the plate 10 and are locked in position to resist movement of the food between the compartments 26 and to resist any movement of the propellers 24 during the dining activity, Thus, the propellers 24, which are preferably constituted of a resilient material, such as plastic, are slightly flexed, bent and tensioned, until the propellers 24 are angularly offset by the angular distance "x" (see FIG. 2) from the pin axes 34 prior to locking the tensioned propellers 24 in position on the plate 10.

The propellers 24 have outer ends that extend past the periphery 12. The periphery 12 of the plate 10 has a first plurality or set of equiangularly arranged slits 18A for receiving the outer ends of the propellers 24 when the inner ends are mounted in the closed slots 18, and a second plurality or set of equiangularly arranged slits 20A for receiving the outer ends of the propellers 24 when the inner ends are mounted in the open slots 20. The propellers 24 are tensioned as described above by being bent to the angular distance "x" that is shown in FIG. 2. The outer ends of the tensioned propellers 24 are pushed with pressure into the set of slits 18A or 20A and, thus, the tensioned propellers 24 are received, held tightly, and locked within their respective sets of slits 18A or 20A with a locking force during the dining activity until the tensioned propellers 24 are unlocked, as described below during the recreational activity.

Once the food and/or liquid substances have been consumed and/or the eating and/or drinking activity is over, the plate 10 need not be discarded as in the known art, but can be used for a different purpose, such as in recreation, in which the propeller food plate assembly is thrown and spun, i.e., rotated about the axis 14, in the air by a user. The propeller food plate assembly can be thrown and tossed back-and-forth from one person to one or more other persons during a "throw-and-catch" recreational sports activity or game that is familiarly known as "playing frisbee". To initiate the recreational activity or flight, the tensioned propellers 24 are unlocked, for example, by lifting the outer ends of the tensioned propellers 24 out of their respective sets of slits 18A or 20A with a lifting force sufficient to overcome the aforementioned locking force.

As best shown in FIG. 3, the inner ends or pins 32 of the propellers 24 are mounted in the slots 18, or alternatively in the slots 20, with a clearance, and the pins 32 are movable along the slots 18 or 20 when the propellers 24 are unlocked during the recreational activity. At a beginning stage of the flight, the propeller food plate assembly is initially thrown and spun, i.e., rotated, in the air by the user. The propeller component and the plate component initially engage each other in a torque-transmitting relationship during their joint rotation about the vertical axis 14 during such flight and, together with the propellers 24 that have contoured, aerodynamic surfaces, cause the assembly to further spin and rotate about the vertical axis 14 with an enhanced aerodynamic flight characteristic, which is determined and controlled, at least in part, by the aerodynamic surfaces of the specific propellers 24 that are used.

At a subsequent stage of the recreational activity or flight, the propeller component, i.e., the propellers 24 and the collar 22 together, moves along the slots 18 or 20 relative to the plate component. The propellers 24 advantageously provide elevation and lift to the plate component in accordance with Bernoulli's principle, and also rotate the plate component with gyroscopic inertia about the vertical axis 14 to enhance and extend its flying range, which is effected by also raising and/or lowering the propeller component along the vertical axis 14. The plate component is balanced during such rotary motion. A discussion of Bernoulli's principle and of gyroscopic inertia can be found in the, publication "The Physics of Flying Discs", by Eugene Motoyama, published Dec. 13, 2002.

When the upwardly dosed slots 18 are used, the inner ends or pins 32 of the propellers 24 are confined within the upwardly closed slots 18 throughout the recreational activity. Analogously, the inner ends or pins 32 of the propellers 24 may be mounted in the upwardly open slots 20 with a clearance and are movable along the slots 18 when the propellers 24 are unlocked during the recreational activity. When the upwardly open slots 20 are used, the inner ends or pins 32 of the propellers 24 may escape from the upwardly open slots 20, and the propeller component may fly away or glide from the plate component during the recreational activity due to inertia. In the event that the collar 22 is made up of a plurality of the collar segments 23, 25, 27, as described above in connection with the upwardly open slots 20, then the interconnected collar segments will move, and fly away, as one piece, relative to the plate component.

Figure 4:
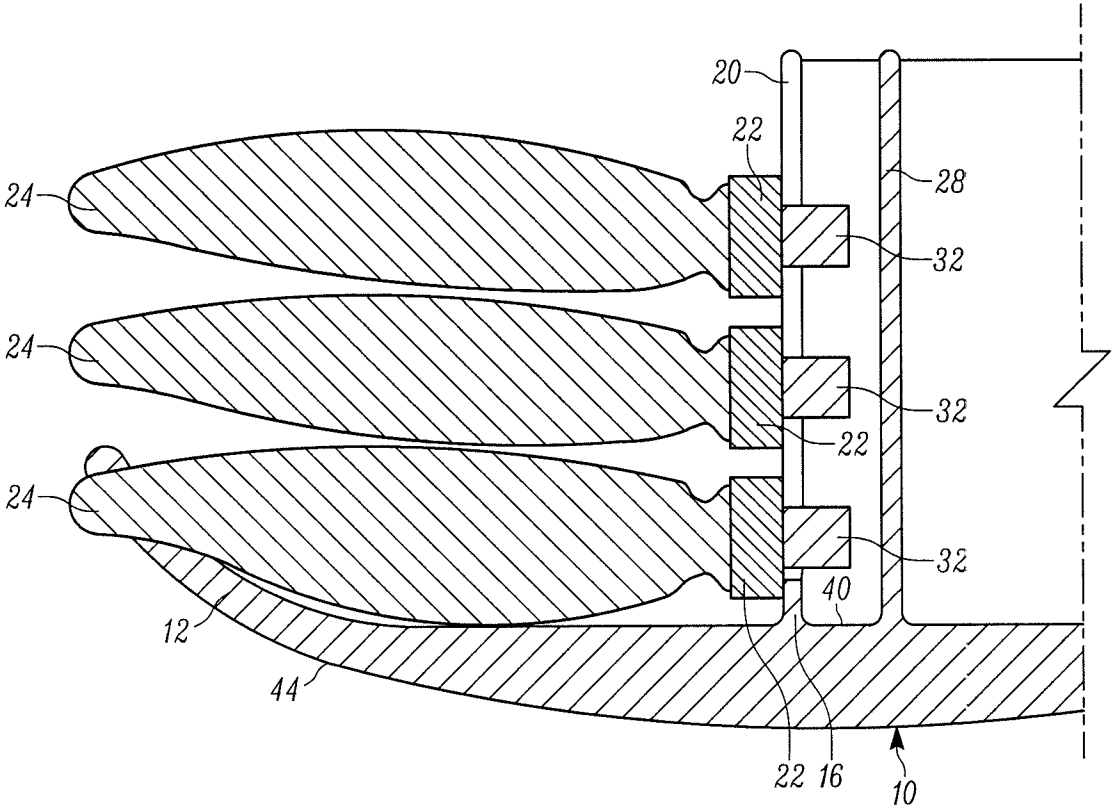
FIG. 4 is a broken-away, sectional view of another embodiment analogous to the propeller food plate assembly.

Only a single propeller component is used during the dining activity. FIG. 4 illustrates a modified slotted embodiment used in the recreational activity and has a plurality of additional propeller components, each comprising a respective plurality of the propellers 24 and a respective collar 22, The propeller components are stacked in levels or tiers, one directly above, and vertically aligned with, one another, on the plate 10 along the vertical axis 14. In this vertically aligned stacked modification, one, or more, or all, of the propeller components may escape, one by one, by inertia from the upwardly open slots 20 and fly away or glide from the plate component during the recreational activity, Any number of the propeller components and tiers may be utilized or combined. All the directly stacked, combined propeller components may be considered as effectively acting as a single propeller component, where the additional propeller components increase the total aerodynamic surface area for the propeller food plate assembly to enhance the aerodynamic flight characteristics and flying performance of the assembly. The propeller components may advantageously be differently colored, for example, with bright or glowing colors, to enhance the visual and ornamental effect when they separate and fly away or glide from the plate component.

Figure 5:
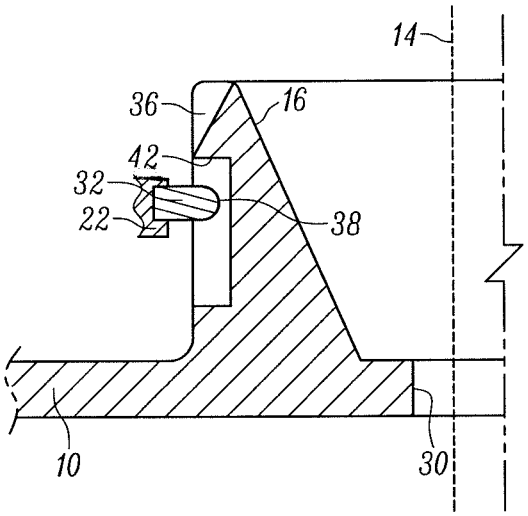
FIG. 5 is a broken-away, sectional view of still another embodiment analogous to the propeller food plate assembly.

In contrast to the slotted embodiments of FIGS. 1-4, in which the upwardly open slots 20 and the upwardly closed slots 18 extend radially all the way through the central portion 16, FIG. 5 illustrates another modified slotted embodiment in which a plurality of equiangularly arranged slots extend only partially through the central portion 16 and, in effect, form cavities or radially outwardly open slots 42 on an outer surface of the central portion 16. One set of the slots 42 may be upwardly open. Another set of the slots 42 may be upwardly closed". Both sets of the slots 42 may be employed in the same embodiment.

In addition, the central portion 16 of FIG. 5 is formed at its upper end region above the upwardly closed slots 42 with the aforementioned angled, annular, tapered guide 36 that is upwardly open and extends downwardly and outwardly of the vertical axis 14. As before, when the upwardly closed slots 42 are used, the propeller component is initially placed above the plate component, and the inner end or pin 32 of each propeller 24 is initially received in the tapered guide 36. For easy assembly, the propeller component may be slightly tilted relative to the plate component. Thereupon, the resilient collar 22 is forced with a pressure force downwardly over the central portion 16 towards a bottom of the plate 10. During this downward movement, each pin 32 slides and moves vertically downwardly and outwardly along the tapered guide 36. Also, during this downward movement, the outward movement of each pin 32 causes the resilient collar 22 to Hex radially outwardly as the resilient collar 22 approaches the bottom of the plate 10 limit the linear pins 32 enter, and are mounted with clearance, in the upwardly closed slots 42. When assembled on the plate 10, the collar 22 has a free-running fit with the central portion 16. Each pin 32 preferably has a rounded outer surface 38 to facilitate the sliding of the pin 32 along the tapered guide 36 by reducing friction. Although FIG. 5 shows that the pin 32 is received in the slot 42 which is upwardly closed, the pin 42 may also be freely received in a slot 42 which is upwardly open, in which case, the tapered guide 36 could be omitted.

The central portion 16 of FIG. 5 bounds an interior space that can receive a cup for holding a liquid. Thus, the central portion 16 cru) serve as, and replace, the aforementioned cup holder 28, Thus, the central portion 16 of FIG. 5 serves not only as the mount for the propeller component, but also serves as a cup holder. The central portion 16 of FIG. 5 has a solid surface that prevents a finger inserted into the finger hole 30 from coming into inadvertent contact with any food and/or liquid substance. In other variations, the pin 32 may be press-fitted into the inner end of each propeller 24, and each propeller 24 may be keyed to the collar 22. Also, the pin 32 may be retractable or detachable from its respective propeller 24.

At a beginning stage of the recreational activity, the propeller food plate assembly is initially thrown and spun, i.e., rotated, in the air by a user at various orientations, such as at a generally horizontal orientation generally parallel to the ground. The pins 32 of the propeller component and the slots 18, 20, 42 of the plate component initially engage each other in a torque-transmitting relationship during their joint rotation about the vertical axis 14 during such flight, and, together with the propellers 24 that have contoured, aerodynamic surfaces, cause the assembly to further spin and rotate with an increased torque about the vertical axis 14 to enhance the overall flying performance or aerodynamic flight characteristic, which is determined and controlled, at least in part, by the aerodynamic surfaces of the specific propellers 24 that are used.

At a subsequent stage of the recreational activity or flight, when spun in the air in a generally parabolic trajectory, after the top of the parabolic trajectory has been reached, the propeller food plate assembly starts to descend towards the ground, the propeller component, Le., the propellers 24 and the collar 22 together, moves away from the plate component, and the propeller component tends to ascend the slots 18 or 20 or 42 due to inertia. In the case where the upwardly open slots 20 are employed, one, some, or all, of the propeller components may separate from, and fly off, the plate component, one by one, due to inertia.

Different shapes and angles for the contoured surfaces of the propellers 24, different lengths of the propellers 24, different total aerodynamic surface areas for the propellers 24, different numbers and layouts of the propellers 24, and different orientations of the propeller food plate assembly can create different aerodynamic flight characteristics, flight patterns, and overall aerodynamic performances. For example, if the propeller food plate assembly is thrown and spun at a wide vertical orientation that is angularly offset from the vertical that is perpendicular to the ground, then a propeller component may return to a thrower with a boomerang-type return action. The plate 10 may preferably be formed with a curved bottom surface 44 (see FIG. 4) that is shaped like a wing or air foil to further enhance the aerodynamic, flying performance, The propellers 24 may be interchangeably mounted on the collar 22, in which case propellers having different aerodynamic characteristics, different profiled curvatures or shapes, and different lengths may be selected and substituted for other propellers to achieve different flying performances. Flight patterns can also extend between multiple users. When multiple propeller components having different aerodynamic characteristics are used, each propeller component that flies off the plate component may travel along its own unique trajectory or flight pattern. This enhances the user game-playing experience where one or more users are challenged to catch these differently flying propeller components.

Figure 6:
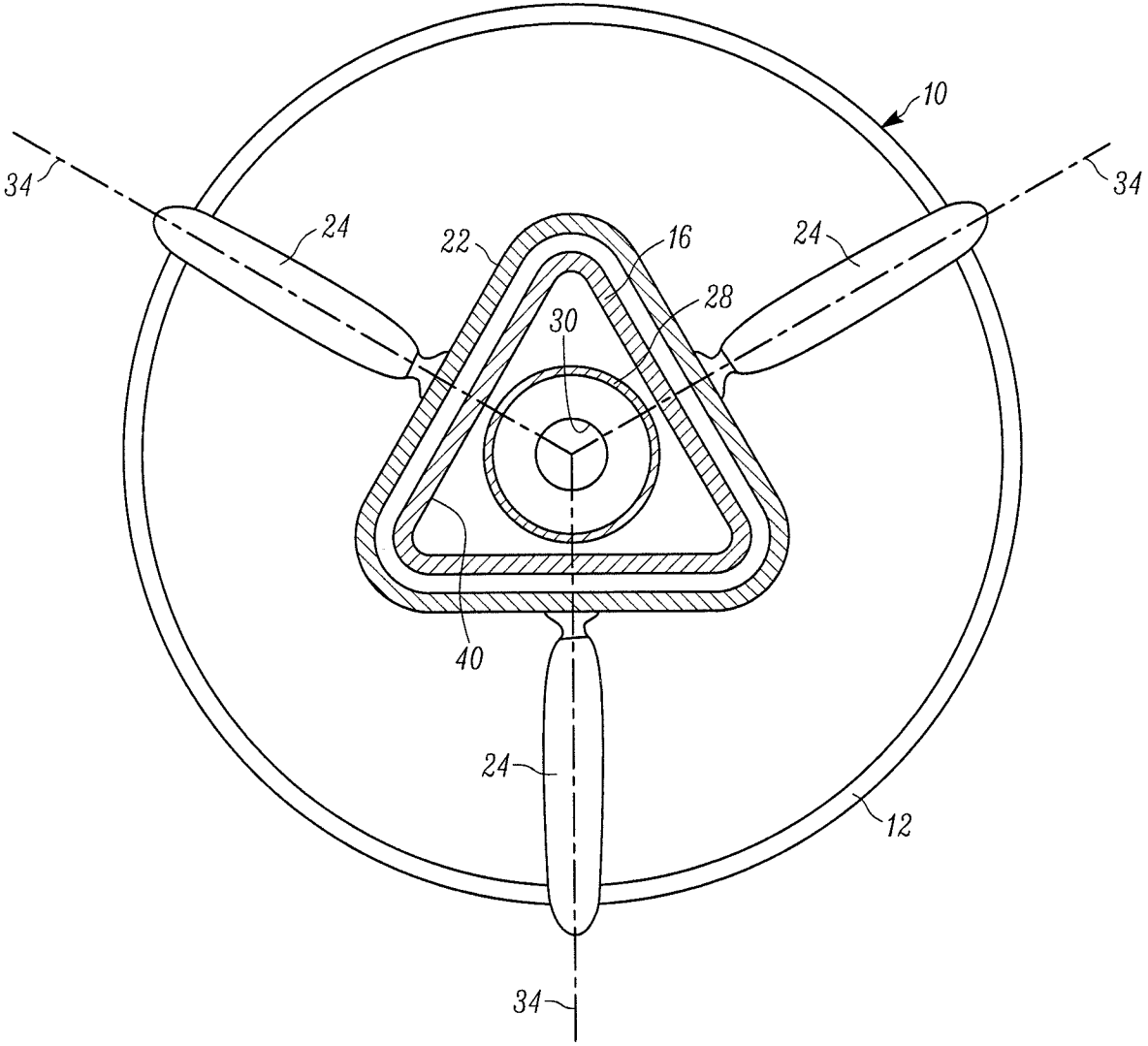
FIG. 6 is a top plan view of yet another embodiment of a propeller food plate assembly in accordance with this disclosure in an unlocked state.

Turning now to the unslotted embodiment shown in FIG. 6 of the drawings, the central portion 16 and the collar 22 are each preferably polygonal in shape, e.g., as shown, equilateral triangles, etc. Once assembled, as shown in FIG. 6, the polygonal collar 22 closely surrounds the polygonal central portion 16 with a free-running fit clearance. The aforementioned slots 18, 20, 42 on the central portion 16 have been eliminated. The inner ends of the propellers 24 are not inserted into any non-existent slots, but instead, are integral with, or connected directly to, the collar 22. For example, the inner ends may be studs that are press-fitted in corresponding bores in the collar 22, and thus, each propeller 24 may be keyed to the collar 22, Once the embodiment of FIG. 6 is thrown and spun in the air, the polygonal central portion 16 of the plate component physically engages the surrounding polygonal collar 22 of the propeller component, and they initially jointly rotate in a torque-transmitting relationship. Subsequently, the propellers 24 increase the overall torque, and the propeller and plate components eventually separate from one another, as described above.

Figure 7:
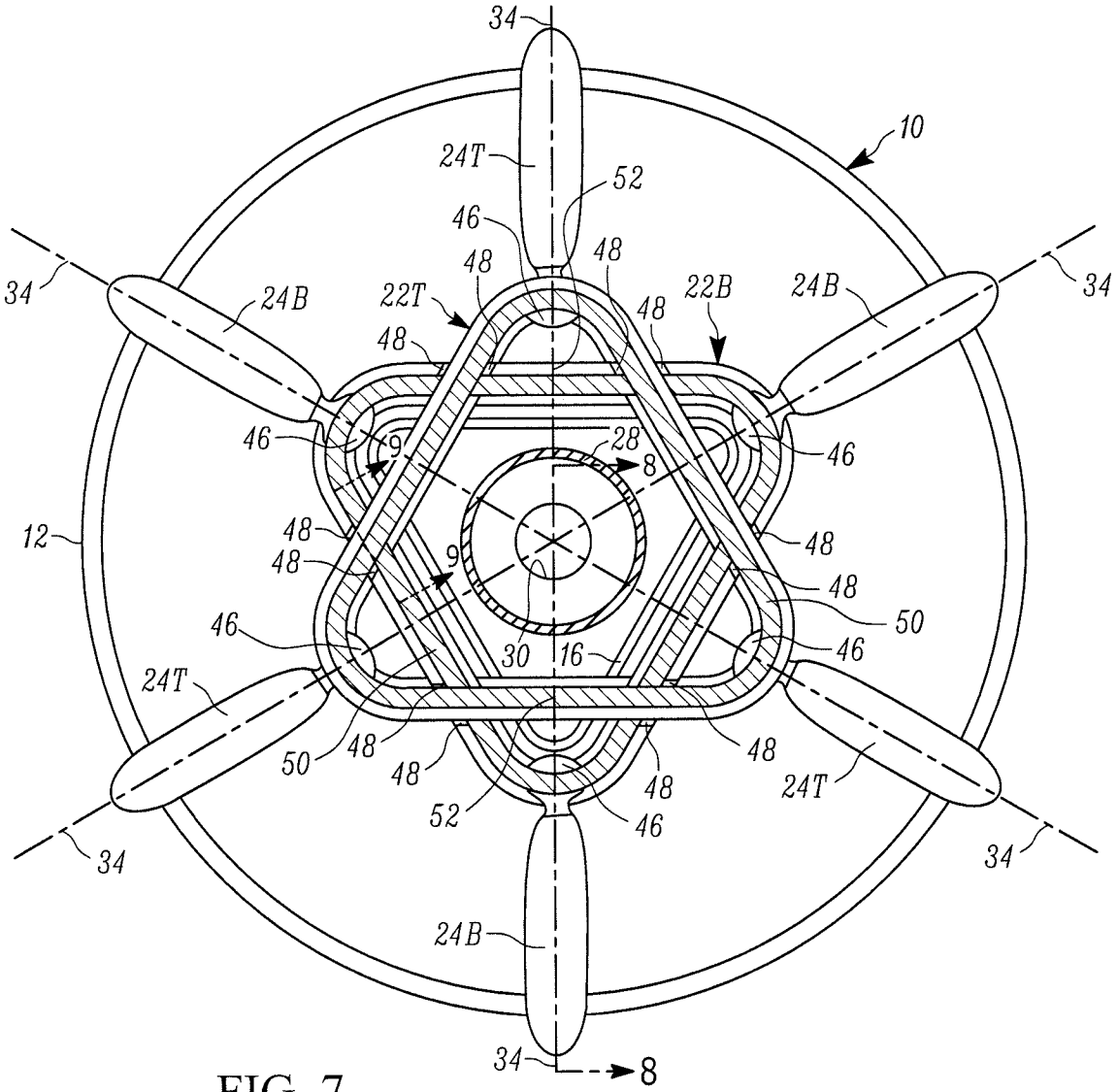
FIG. 7 is a top plan view of a further embodiment of a propeller food plate assembly in accordance with this disclosure in an unlocked state.

In an alternate unslotted embodiment depicted in FIG. 7, during the recreational activity, the propeller components are again stacked in levels or tiers, one above another, on the plate 10 along the vertical axis 14, as described above in connection with FIG. 4, but, in addition, the propeller components are angularly offset by 180 degrees from each other about the vertical axis 14, and the offset propeller components together resemble a star having a hexagram configuration, as seen from above the assembly, As shown in FIG. 7, a bottom polygonal collar 22B of a lower propeller component is underneath, and angularly offset from, a top polygonal collar 22T of an upper propeller component The bottom polygonal collar 22B is located exteriorly of the polygonal central portion 16 with a free-running fit clearance. The propellers of the lower propeller component have been identified by the numerals 24B, and propellers of the upper propeller component have been identified by the numerals 24T.

Figure 8:
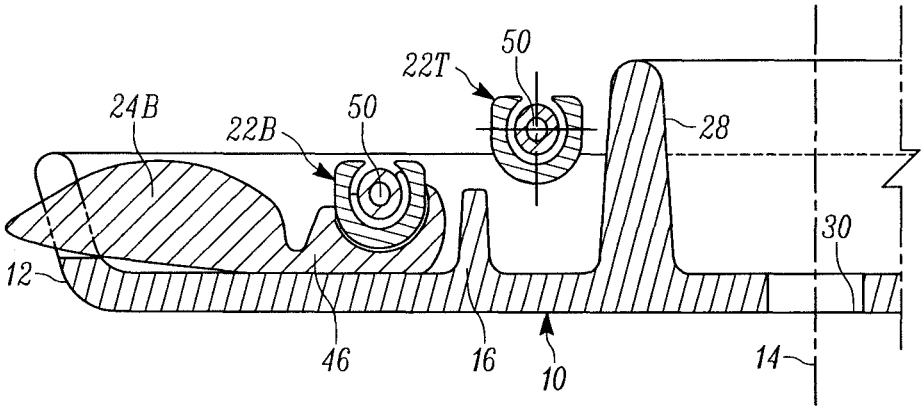
FIG. 8 is a broken-away, sectional view taken on line 8-8 of FIG. 7.
Figure 9:
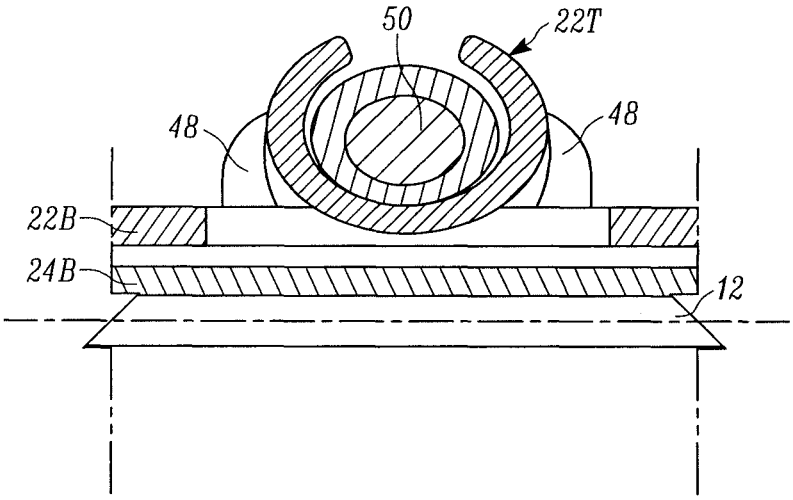
FIG. 9 is a broken-away, sectional view taken on line 9-9 of FIG. 7.

As best shown in FIG. 8, instead of using a press-fit connection, the inner end of each propeller 24B is formed with a snap mount 46 into which each bottom polygonal collar 22B is mounted. The same snap mount 46 is preferably employed for each propeller 24T and its corresponding top polygonal collar 22T. As also shown in FIG. 8, the height of the central portion 16 is about the same as the height of the lower propeller component. This provides clearance for the upper propeller component to be mounted on top of the lower propeller component without interference from the central portion 16. As best shown in FIG. 9, the top polygonal collar 22T is advantageously snap-mounted on the bottom polygonal collar 22B, thereby securely holding and connecting the stacked propeller components together. These stacked and interconnected propeller components move in unison and maintain the hexagram configuration during their escape from the plate component at the subsequent stage of the recreational activity.

Figure 10:
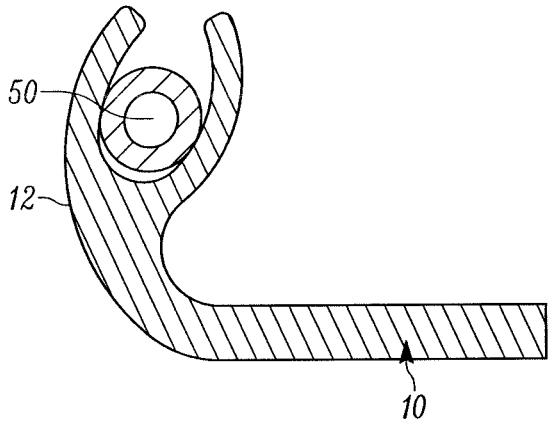
FIG. 10 is a broken-away, sectional view of the periphery of a modified plate component of the propeller food plate assembly.

One or more light sources 50 are preferably added to the assembly. Each light source 50 may be an elongated glow stick, which is a self-contained, chemiluminescent light source. The glove stick 50 consists of an inner brittle container within an outer flexible translucent plastic tubular container. Each container holds a different chemical solution. When the outer container is flexed, the inner container breaks, allowing the solutions to combine, thereby causing a chemical reaction. After breaking, the glow stick 50 is shaken to thoroughly mix the components. The chemical reaction produces light through chemiluminescence. No external energy source is present Each chemiluminescent light source. 50 is mounted on, and bent to be routed along, any external surface of the collars 22B, 22T. As shown, each chemiluminescent light source 50 is mounted on an upper surface of each of the collars 22B, 22T. The opposite ends of the light source 50 preferably meet at an end surface 52. Preferably, each upper surface of the collars 22B, 22T is formed with a channel into which the light source 50 is received and securely held. The mounting of the chemiluminescent light source 50 on, and along, each of the collars 22B, 22T of the propeller components, which are interconnected in the aforementioned hexagram configuration, is particularly advantageous when the interconnected propeller components fly in unison away from the plate component, since the emitted light is also visible in the hexagram configuration. As shown in FIG. 10, the chemiluminescent light source. 50 can also be mounted on, and bent to be routed along, the periphery 12 of the plate 10. The periphery 12 is advantageously also formed with a channel to receive and hold the light source. The use of such chemiluminescent light source 50 may also find beneficial uses in other flying devices, such as drones, frisbees, flying discs, etc. The chemiluminescent light source 50 may be employed not only during the recreational activity, but also during the dining activity.

Figure 11:
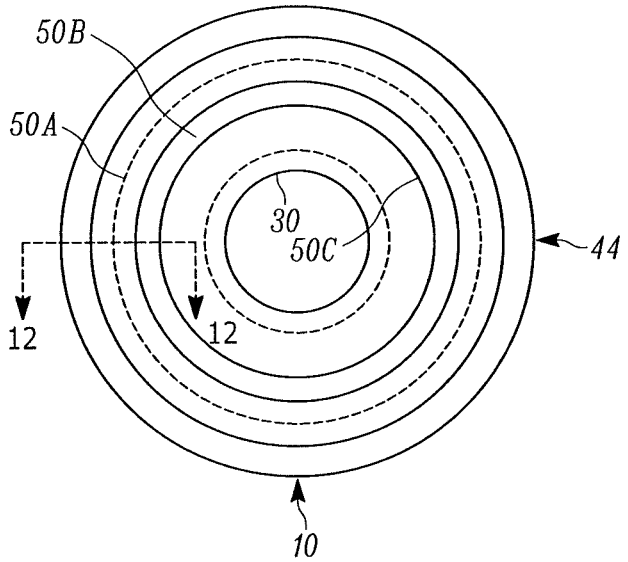
FIG. 11 is a bottom plan view of a plate component on a reduced scale.
Figure 12:
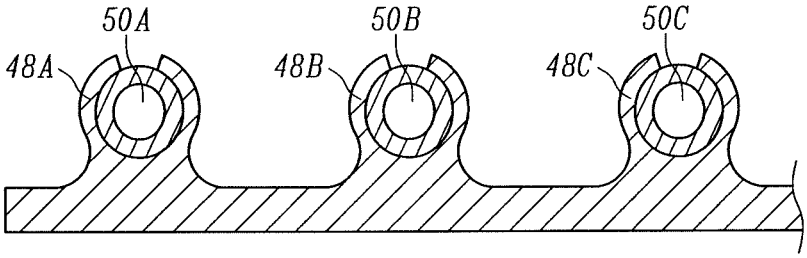
FIG. 12 is a broken-away, sectional view taken on line 12-12 of FIG. 11.
Figure 13:
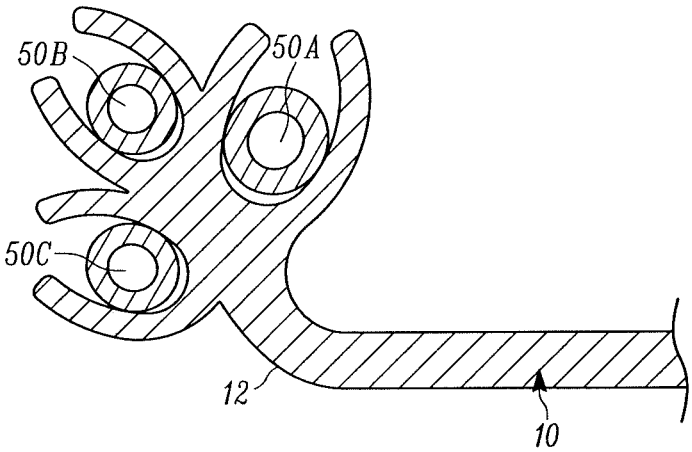
FIG. 13 is a broken-away, sectional view of the periphery of a modified plate component of the propeller food plate assembly.

As shown in FIGS. 10-11, a plurality of the chemiluminescent light sources 50A, 50B, 50C can also be bent, routed, and mounted on the underside or the bottom surface 44 of the plate 10. The light sources 50A, 50B, 50C may emit light of different colors that are characteristic of different holidays, such as red, white and blue in celebration of the Fourth of July holiday, or of different colors on flags of various countries in celebration of their national holidays, or of different colors of various sports teams, etc. Each light source 50A, 50B, 50C is securely captured in a corresponding plurality of snap mounts 48A, 48B, 48C, and may be readily interchanged or replaced with another light source of the same or a different color. As shown, the snap mounts 48A. 48B, 48C are concentrically circular in shape, but they may be of any shape. As shown in FIG. 11, the differently colored light sources source 50A, 50B, 50C can also be mounted on, and bent to be routed along, the periphery 12 of the plate 10. The periphery 12 is advantageously modified and formed with a plurality of channels to receive and hold the light sources 50A, 50B, 50C. All of these illuminated modifications create an attractive and ornamental light display not only during the recreational activity, but also during the dining activity, especially at night.

Figure 14:
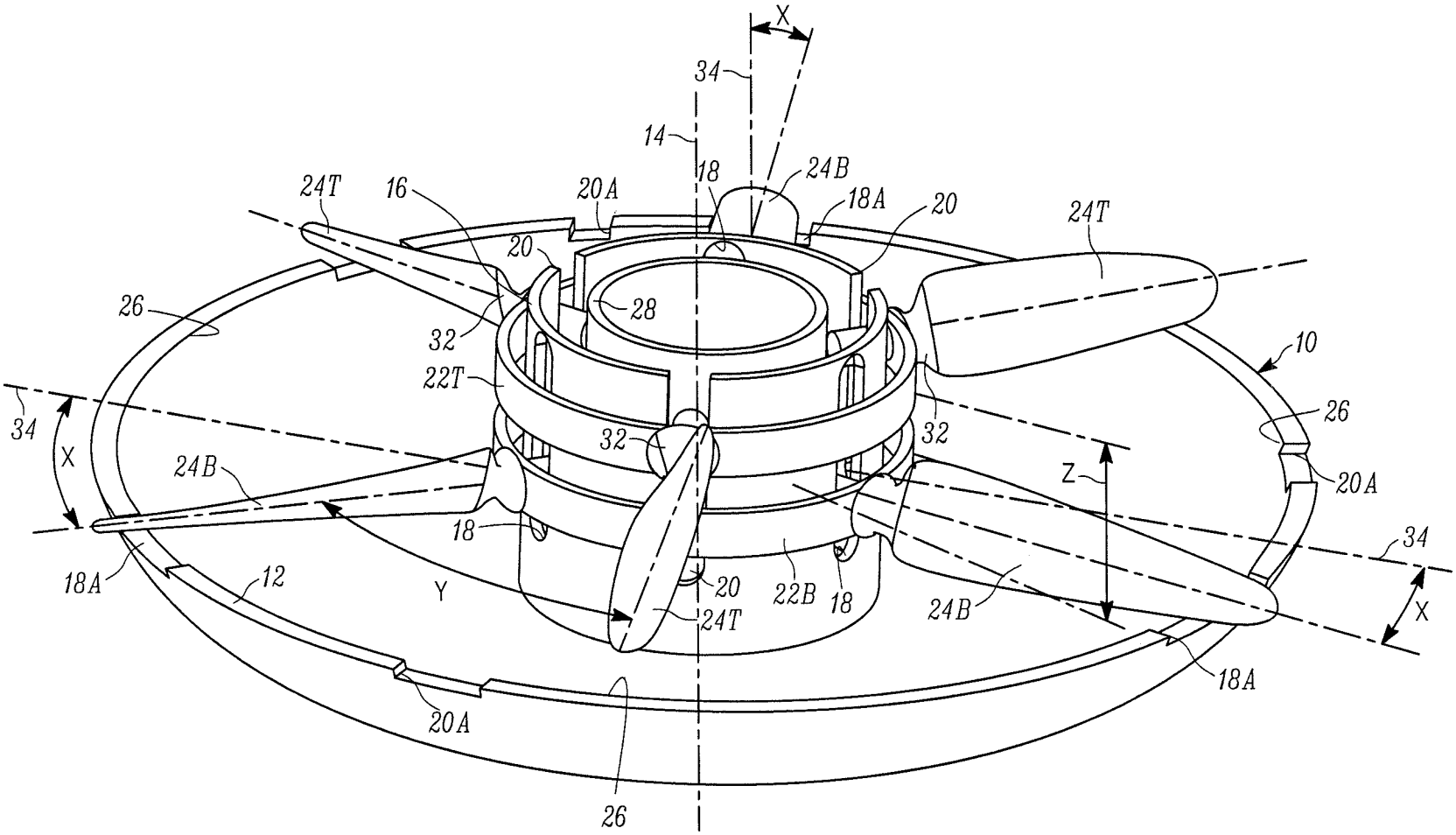
FIG. 14 is a perspective view of yet another embodiment of a propeller food plate assembly in accordance with this disclosure.

Turning now to the slotted embodiment of FIG. 14, this embodiment is analogous to that of FIG. 1, except rather than a single propeller component being illustrated, two propeller components are illustrated as being exteriorly mounted on, and vertically stacked along, the central portion 16, each with a free-running fit clearance. As before, the central portion 16 has a first set of upwardly dosed slots 18 and a second set of upwardly open slots 20. For clarity, a lower propeller component has a bottom collar 22B and a plurality of bottom propellers 24B, and an upper propeller component has a top collar 22T and a plurality of top propellers 24T.

The bottom propellers 24B have inner ends preferably configured as pins 32 that are mounted in the upwardly closed slots 18 with clearance. The top propellers 24T also have inner ends preferably configured as pins 32 that are mounted in the upwardly open slots 20 with clearance. The lower propeller component is underneath the upper propeller component and is vertically spaced therefrom by the illustrated vertical dimension "z". The top propellers 24T are angularly offset from the bottom propellers 24B by the illustrated angular dimension "y".

During the recreational activity, all the pins 32 engage all the slots 18, 20 in a torque-transmitting relationship during an initial stage of the recreational activity. During a subsequent stage of the recreational activity, the pins 32 in the upwardly open slots 20 may escape therefrom, and the upper propeller component may fly away or glide from the plate component due to inertia, as described above. Any number of additional propeller components is contemplated by this disclosure. Thus, the assembly may have any number of levels or tiers of propeller components. Each additional propeller component or tier increases the number of the propellers of the assembly to enhance an aerodynamic flight characteristic of the assembly. The aerodynamic flight characteristic is also enhanced by selection of the vertical dimension "z" and/or by selection of the angular dimension "y".

Figure 15:
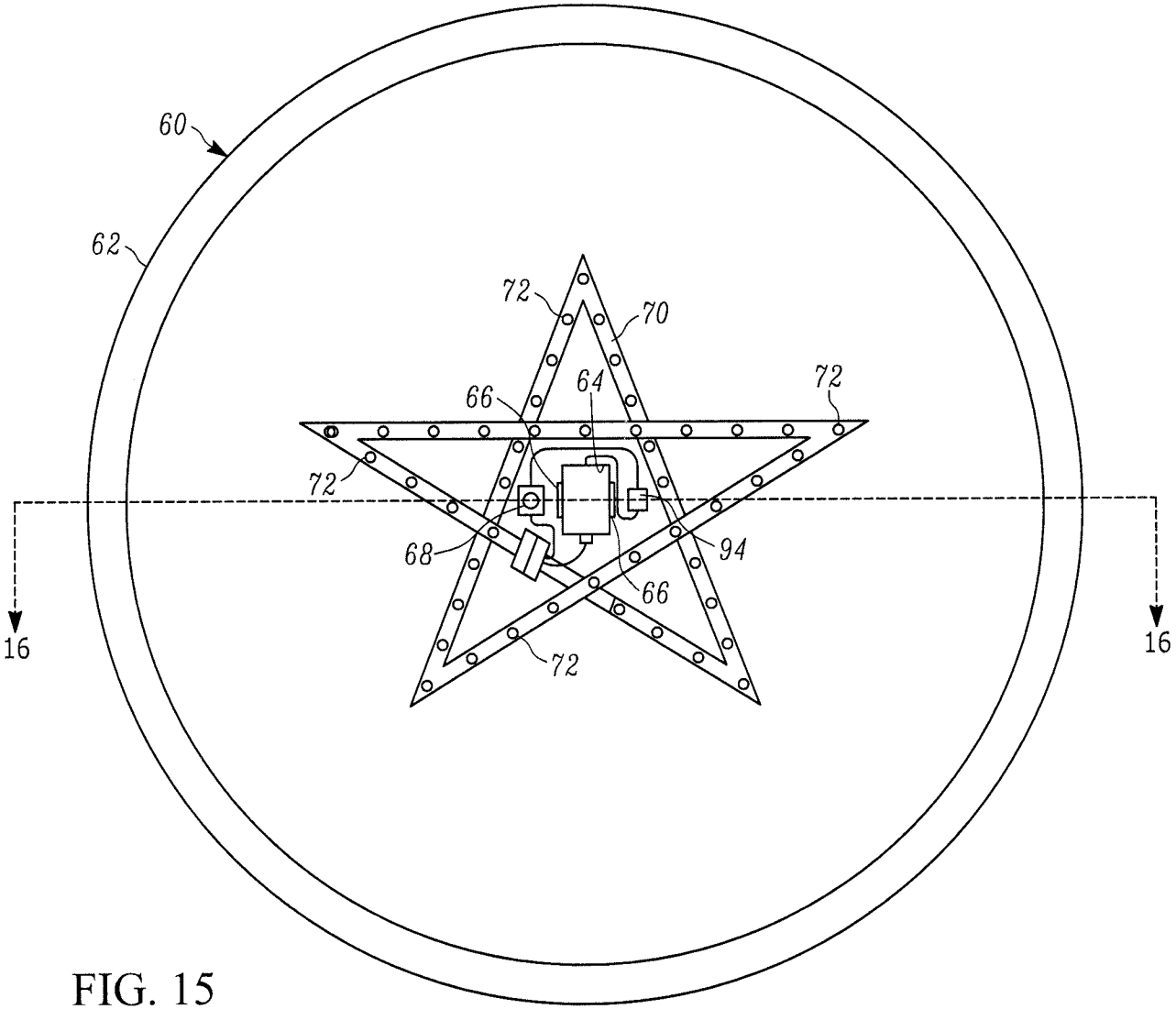
FIG. 15 is a top plan view of a cover for use with a propeller food plate assembly in accordance with this disclosure.
Figure 16:
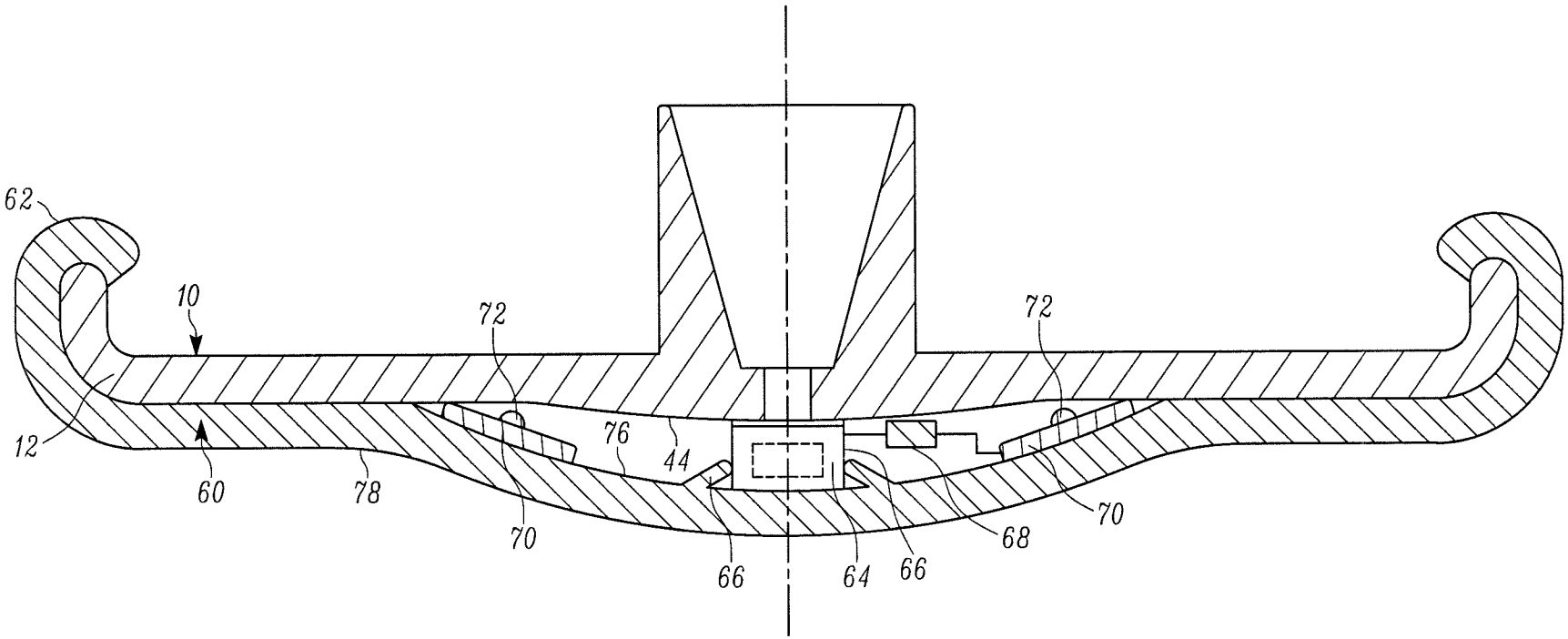
FIG. 16 is a sectional view taken on line 16-16 of FIG. 15.

Rather than using one or more chemiluminescent light sources 50, FIG. 15 depicts a resilient, flexible cover 60 on which a battery-operated light source 70, as described below, is mounted. The cover 60 is light-transmissive, preferably transparent. As shown in FIG. 16, the cover 60 is mounted over the bottom surface 44 of the plate 10. More particularly, the cover 60 has a curved lip 62 that is preferably snap-mounted on the curved periphery 12 of the plate 10. The aforementioned propeller component(s) have been omitted from FIG. 16 for the sake of simplifying the drawings.

A battery 64, preferably a rechargeable DC battery, and/or a camera 94, as described below, are also mounted on the cover 60, preferably at a central location. The battery 64 is held in place by a pair of supports 66 at opposite sides of the battery 64. A push button switch 68 is connected to the battery 64 and/or the camera 94 and to the battery-operated light source 70, which is show as a plurality of lights, preferably light-emitting diodes (LEDs) 72, arranged along elongated electrical conductors that are contained within a flexible ribbon, stripe, or string. The light source 70 may be arranged in any pattern, such as the illustrated five-pointed star, The light source 70, the switch 68, the battery 64, and the camera 94 may be held in place by being sandwiched and pressed between the cover 60 and the bottom surface 44 of the plate 10 in a cavity or compartment 76 and/or may be additionally held in place by tape or Velcro (not illustrated). It will be understood that a plurality of batteries 64 and a plurality of light sources 70 may also be used.

In use, the user may actuate the switch 68, and energize the LEDs 72 and/or the camera 94. Then, the user may snap-mount the curved lip 62 of the cover 60 over the curved periphery 12 of the plate 10. The light emitted by the LEDs 72 will pass through the transparent cover 60. The camera 94 will capture images through the transparent cover 60. In this example, an illuminated five-pointed star pattern of light will be visible. A bottom surface 78 of the cover 60 is preferably aerodynamic in shape. The bottom surface 78 may bear pre-applied indicia, such as advertisements, logos, paintings, artwork, slogans, ornamentation, etc., and/or may also receive indicia that are subsequently applied by the user, for example, with washable ink or paint.

Figure 17:
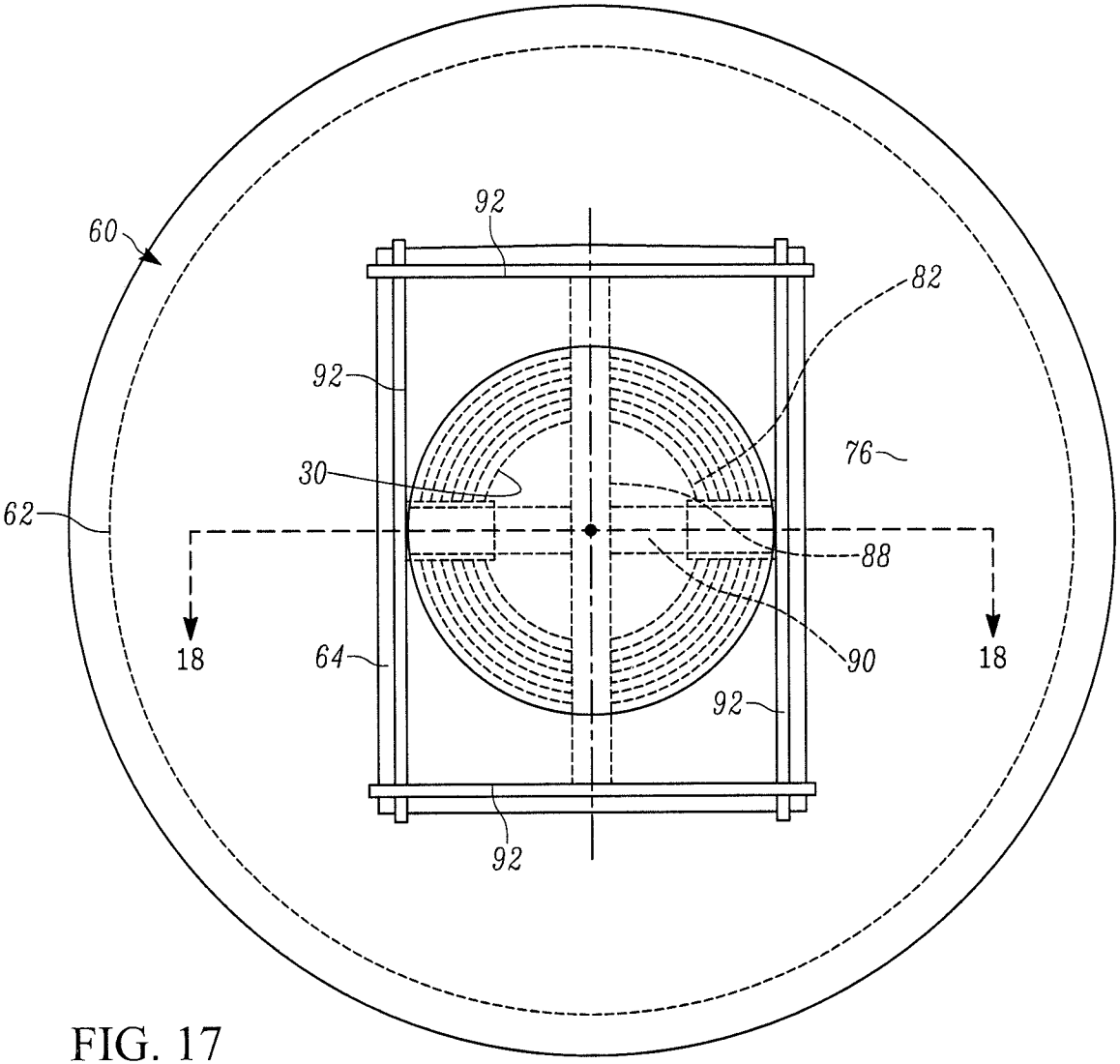
FIG. 17 is a bottom plan view of the cover for use with a modified propeller food plate assembly in accordance with this disclosure.
Figure 18:
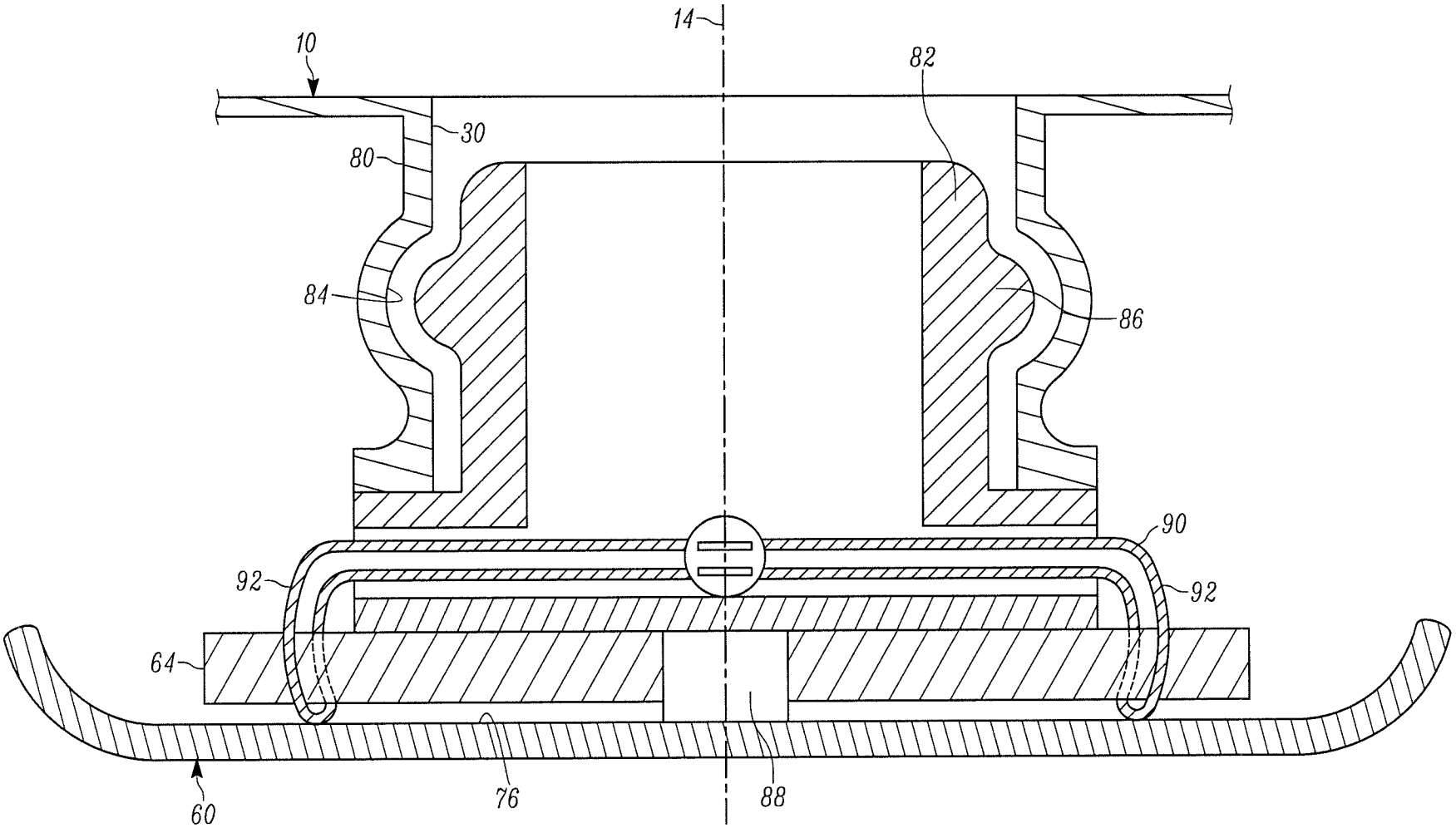
FIG. 18 is a broken-away, sectional view taken on line 18-18 of FIG. 17.

Rather than mounting the battery 64 on the cover 60, the battery 64 can also be mounted on the plate 10, as shown in FIGS. 17-18. As best shown in FIG. 18, a hollow cylindrical neck 80 extends axially downwardly of the plate 10 away from the center finger hole 30, and is centered on the axis 14. The neck 80 is preferably integral with the plate 10 and is preferably constituted of a resilient material. An upper region of a support 82 is axially inserted into the neck 80, The neck 80 has an annular recess 84 that receives with snap action an annular projection 86 that is provided exteriorly around the upper region of the support 82, The support 82 is preferably mounted and held in a central position by the aforementioned snap-action engagement, but it will be understood that other types of engagements, such as a friction-fit, may also be used.

The battery 64 is mounted on, and preferably suspended from, the support 82 by one or more endless, elastic bands 88, 90, or Velcro strips. The support 82 has a lower region formed with at least one channel, and preferably, a pair of cross channels that are arranged at right angles to each other, and the bands 88, 90 are routed through and past these channels to form a plurality of end loops 92. The battery 64 is suspended from these end loops 92 within the compartment. The bands 88, 90 can accommodate batteries of different shapes and sizes, As previously described, one or more batteries 64 may be used to power the light sources, and in addition, may be used to power one or more cameras 94 (see FIG. 15) that may also be mounted within the compartment 76, Each camera 94 may capture and record images, and/or transmit captured images via wireless link, e.g., Wi-Fi, Bluetooth, etc., to a receiver or display, for example, on one's smartphone, tablet, computer, etc. In the embodiments of FIGS. 15-18, the battery 64 and/or camera 94 are centrally mounted on the axis 14, and the assembly is balanced during both the dining and recreational activities.

In all of the illustrated embodiments, the collars 22, 22A, 22B are illustrated as being rotationally symmetric. It will be understood that non-rotationally-symmetric collars 22, 22A, 22B may also be employed.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions, The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements, but may include other elements not expressly listed or inherent to such process, method, article, or apparatus. An element proceeded by "comprises, . . . , a," "has . . . , a," or "contains . . . a," does not, without more constraints, preclude the existence of additional identical elements in the process, method, article, or apparatus that comprises, has, includes, or contains the element The terms "a" and "an" are defined as one or more unless explicitly stated otherwise herein, The terms "substantially," "essentially," "approximately," "about," or any other version thereof, are defined as being close to, as understood by one of ordinary skill in the art. The term "coupled" is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A propeller food plate assembly, comprising:

a plate component including a plate having a periphery defining a plurality of slits surrounding an axis, and a raised central portion centered on the axis;

a propeller component including a collar centered on the axis and located exteriorly of the central portion with clearance, and a plurality of propellers angularly arranged about the axis and extending from the collar towards the periphery of the plate, wherein outer ends of the plurality of propellers are lockable within the plurality of slits defined by the periphery of the plate to subdivide the plate into a plurality of compartments for holding food during a dining activity; and whereupon during a subsequent recreational activity, the outer ends of the plurality of propellers are unlockable from the plurality of slits defined by the periphery of the plate to enable the propeller component and the plate component to rotate relative to each other.

2. The assembly of claim 1, wherein the central portion has a first set of upwardly closed slots and a second set of upwardly open slots; and additional propeller components, each comprising a respective number of the propellers and a respective collar, wherein the propeller components are stacked in tiers, one above another, on the plate component along the axis, wherein the stacked propeller components are also angularly offset relative to one another about the axis, wherein the propellers of one of the propeller components have inner ends mounted in the upwardly closed slots with clearance, wherein the propellers of another of the propeller components have inner ends mounted in the upwardly open slots with clearance, and wherein all the inner ends engage all the slots in a torque-transmitting relationship during an initial stage of the recreational activity, wherein each additional propeller component and tier increases the number of the propellers of the assembly to enhance an aerodynamic flight characteristic of the assembly during a subsequent stage of the recreational activity, and wherein the angular offset between the propellers of the stacked propeller components and the axial distance along the axis between the stacked propeller components also enhance the aerodynamic flight characteristic.

3. The assembly of claim 1, wherein the propellers are in locking engagement with the plate component to resist relative movement of the propeller and plate components during the dining activity, and are unlocked from said locking engagement during the recreational activity.

4. The assembly of claim 1, wherein the propeller component is engaged in a torque-transmitting relationship with the plate component during an initial stage of the recreational activity, and is movable relative to the central portion away from the plate component during a subsequent stage of the recreational activity, wherein the central portion has a plurality of slots, wherein the propellers extend from the slots through the collar towards and past the periphery of the plate, and wherein the propellers have inner ends mounted in the slots with clearance and engaging the slots in the torque-transmitting relationship during the initial stage of the recreational activity, wherein the slots are linear and upwardly closed to confine the inner ends of the propellers therein during the recreational activity, and wherein the central portion has an angled tapered guide, and wherein each inner end of the propellers slides along the angled tapered guide for receipt in a respective upwardly closed slot.

5. The assembly of claim 4, wherein each inner end of the propellers has a rounded outer surface to facilitate sliding along the angled tapered guide.

6. The assembly of claim 1, and additional propeller components, each comprising a respective plurality of the propellers and a respective collar, wherein the propeller components are stacked in tiers, one directly above, and aligned with, one another, on the plate component along the axis, and wherein all the propellers of all the propeller components together have a total aerodynamic surface area to enhance an aerodynamic flight characteristic of the assembly during the recreational activity.

7. The assembly of claim 1, and additional propeller components, each comprising a respective number of the propellers and a respective collar, wherein the propeller components are stacked in tiers, one above another, on the plate component along the axis, wherein the stacked propeller components are also angularly offset relative to one another about the axis, and wherein each additional propeller component and tier increases the number of the propellers of the assembly to enhance an aerodynamic flight characteristic of the assembly during the recreational activity.

8. The assembly of claim 1, wherein each of the central portion and the collar has a polygonal shape, and wherein the polygonal collar of the propeller component surrounds and is engaged in a torque-transmitting relationship with the polygonal central portion of the plate component during an initial stage of the recreational activity, and is movable away from the plate component during a subsequent stage of the recreational activity.

9. The assembly of claim 8, and additional propeller components, each comprising a respective number of the propellers and a respective polygonal collar, wherein the propeller components are stacked in tiers, one above another, on the plate component along the axis, wherein the stacked propeller components are also angularly offset relative to one another about the axis, and wherein each additional propeller component and tier increases the number of the propellers of the assembly to enhance an aerodynamic flight characteristic of the assembly during the recreational activity.

10. The assembly of claim 9, wherein an upper one of the stacked propeller components is securely mounted on, and inverted relative to, a lower one of the stacked propeller components, and together form a hexagram shape as seen from above the assembly.

11. The assembly of claim 1, and a light source mounted on, and extending along, an upper surface of at least one of the collar, the periphery of the plate, and a bottom surface of the plate.

12. The assembly of claim 11, wherein the light source is a self-contained chemiluminescent light source without any external energy source.

13. The assembly of claim 1, and a light-transmissive cover mounted on a bottom surface of the plate component, and a battery and at least one of a light source and a camera are centrally mounted and pressed between the cover and the plate component.

14. The assembly of claim 1, wherein the plate component has a hole in its center, and a tubular neck extending axially away from the hole; and a support mounted on the neck, wherein the support has at least one channel through and past which at least one elastic band is routed to form at least one end loop, and a battery supported by the at least one end loop.

15. The assembly of claim 14, wherein the support is mounted on the neck with a snap action.

16. The assembly of claim 1, and a plurality of light sources mounted on, and extending along, an upper surface of at least one of the collar, the periphery of the plate, and a bottom surface of the plate, and wherein the light sources emit light of different colors.

* * * * *